United States Patent [19]

Stuhl et al.

[11] Patent Number: 4,944,316

[45] Date of Patent: Jul. 31, 1990

[54] PROCESS FOR TREATING TOBACCO AND SIMILAR ORGANIC MATERIALS

[76] Inventors: Oskar Stuhl, An der Thomaskirche 23, D-400 Düsseldorf 30; Klaus-Dieter Wenzel, Am Kaiserwald 7, D-5503 Konz, both of Fed. Rep. of Germany

[21] Appl. No.: 171,330

[22] Filed: Mar. 21, 1988

Related U.S. Application Data

[63] Continuation-in-part of Ser. No. 30,800, Mar. 27, 1987.

[30] Foreign Application Priority Data

Apr. 22, 1987 [EP] European Pat. Off. ..... 87 105 912.7

[51] Int. Cl.[5] ..... A24B 3/18

[52] U.S. Cl. ..... 131/296; 131/291; 131/903

[58] Field of Search ..... 131/296, 291, 903

[56] References Cited

U.S. PATENT DOCUMENTS 3,524,451 8/1970 Fredrickson .
3,524,452 8/1970 Moser et al. .
3,693,631 9/1972 Moore et al. .
3,765,425 10/1973 Stungis et al. .
3,828,797 8/1974 Neumann et al. .
3,842,846 10/1974 Laszlo .
4,248,252 2/1981 Lendvay et al. .
4,289,148 9/1981 Ziehn .
4,333,482 6/1982 Banyasz .

*Primary Examiner*—V. Millin

[57] ABSTRACT

In order to effect expansion of a shredded material, said material is impregnated with an inert organic liquid, which is subsequently vaporized. The major portion of the impregnation agent is removed by separation. In order to eliminate the residual amount of impregnation agent still contained in the material, the material is fed by conveyor belt (31) into a microwave chamber (35). The microwave chamber (35) is provided with microwave energy under continuous control conditions. The vapors are siphoned off and fed into a regenerator for recovery of the impregnation agent. Conditioned, pressurized air is directed at the material in the microwave chamber (35) through discharge nozzles (38) to cause the material to whirl up and become fluidized. The pressurized air serves as a carrier gas for the residual impregnation agent that is to be removed and may simultaneously be used for conditioning the tobacco.

10 Claims, 2 Drawing Sheets

PROCESS FOR TREATING TOBACCO AND SIMILAR ORGANIC MATERIALS

CROSS REFERENCE TO RELATED APPLICATION

This is a continuation-in-part of co-pending application Ser. No. 030,800 filed Mar. 27, 1987.

BACKGROUND OF THE INVENTION

The invention relates to a process for the treatment of tobacco and similar organic materials, in which the material is impregnated with an inert organic liquid and is heated above the boiling point of this liquid by the introduction of a hot gas, whereby the liquid is vaporized with simultaneous expansion of the material, and in which recovery of a portion of the vaporized liquid is effected after the expansion while a residual amount remains in the material.

A process of this type is known on the basis of DE-A-19 17 552 and DE-A-22 03 105. In the known processes, tobacco is impregnated with liquid or vaporous inert organic compounds. The impregnation agent is vaporized during a subsequent heat treatment with a gas such as steam whereby the tobacco expands, i.e., a delamination and volume enlargement of the tobacco takes place. In order to reduce to a minimum the extraction of the soluble components which are normally present in the tobacco that is to be treated, the impregnating fluid should be introduced into the tobacco in a vaporous state. This permits a reduction in the amount of the impregnation agent required. During the tobacco expansion, its filling capacity is increased by 60 to 120%. The impregnation agent which vaporizes during the expansion is removed together with the gas. The expansion agent can be recovered from the mixture. A disadvantage of the known process is that a residual amount of the impregnation agent remains in the expanded tobacco. In order to remove these residual amounts from the expanded tobacco, it is necessary to store the tobacco over longer periods of time until the impregnation agent has evaporated. Such storage times, however, constitute lost time in the treatment of the tobacco and they require corresponding storage facilities equipped for the conditioning of tobacco. The residual amounts removed by the storage can only be recovered with great difficulty.

According to U.S. Pat. No. 3 828 797 it is known to carry out the expansion of tobacco by subjecting tobacco impregnated with a volatile, organic liquid to a microwave treatment. In that process the total energy required for vaporizing the expansion agent is introduced in the form of microwaves. Such an energy-rich treatment with microwaves, however, involves extraordinary difficulties on a large production scale because an overheating of the tobacco material can easily occur during the complete vaporization of the expansion agent. It is practically impossible to regulate the microwave energy in such a way that complete vaporization of the expansion agent is achieved without overheating of the tobacco. Furthermore, the energy consumption of this known process is very high. Even though the process functions well under laboratory conditions it is difficult to execute on a large production scale.

A process is described in an older (not previously published) application, EP 86 105 606.7, in which the residual amount of impregnation agent that remains in the tobacco after the expansion is removed from the tobacco by subjecting the tobacco to a microwave treatment, whereby the residual amount of the impregnating liquid is vaporized and is withdrawn for recovery. This process entails a considerable space requirement and the amount of the material treated per unit time can be varied only to a limited extent for a given size of installation, any increases in the amount treated being obtainable only with great difficulty. Moreover, an expensive control system is necessary. In a few exceptional cases such as the case of a control system that is not properly synchronized or is defective, it is possible that the tobacco would lump together and lead to non-uniform microwave treatment. The possibility would then exist that the impregnation agent might not be removed completely from the deeper layers of the tobacco.

SUMMARY OF THE INVENTION

It is the object of the invention to provide a process of the type described above which permits a uniform and complete removal of the residual impregnation agent from the tobacco under gentle tobacco treatment conditions.

The realization of this objective in accordance with the invention comprises subjecting the material (for example the tobacco) to a microwave treatment after the expansion, whereby the residual amount of the impregnating liquid is vaporized and is withdrawn for recovery, and that a second gas is blown into the organic material during treatment with the microwaves to expel the impregnation agent.

In the process in accordance with the invention a second gas, whose temperature and/or moisture content can be controlled, is blown into the organic material under pressure. The organic material is dispersed as a result of this treatment and it results in a more uniform microwave treatment. A lumping together of the organic material is prevented with the result that localized overheating is avoided. Vaporization and removal of impregnant residues is facilitated by means of the gas flow. Furthermore, the injected gas eliminates the possibility that microwave irradiation might adversely affect the volume of the organic material which is obtained in the preceding expansion step. The dispersed state of the material is maintained by means of the injected gas.

A particular advantage associated with the process according to the invention resides in the improvement of the control of process parameters during the microwave treatment. For example, the speed of the conveyor in the microwave chamber and/or the velocity of the gas flow during the microwave treatment and/or the emitted power of the microwave source can be changed or regulated. Furthermore, it is possible to adjust the initial humidity and temperature of the gas injected into the microwave facility in such a manner that the tobacco emerging from the microwave chamber has a certain final moisture. In this manner separate drying and/or moistening steps can be omitted. The gas stream, which penetrates the material being treated, effects a uniform removal of the impregnation agent and simultaneously assumes the function of a carrier gas for the residual impregnation agent. The recovery of the impregnation agent is simplified. The treatment in the microwave chamber may be carried out in a continuous operation and by a simple control.

The invention furthermore relates to a microwave oven for conducting the process described above.

In accordance with the invention, a conveyor is designed to be located in the microwave chamber with the second gas being discharged from nozzle means associated with the transporting surface of the conveyor. A kind of fluidized bed is formed above the transporting surface of this conveyor in which the organic material whirls up and is kept suspended temporarily. The gas discharge need not extend over the entire length of the conveyor. The term "conveyor" does not necessarily refer to a single conveyor installation. It is also possible for a number of conveyor means to be arranged in successive order.

The gas treatment of the organic material located on the conveyor can also be achieved by gas discharged from apertures which are independent of the conveyor, for example on the wall of the microwave chamber. Consequently, it is not required that the gas flows against the organic material from below even though this constitutes a preferred embodiment of the invention. Fluidization and an improvement of the removal of the impregnation agent is also achieved when the gas delivery apertures are located on the side walls or on the ceiling of the microwave chamber.

An embodiment of the invention is explained below in more detail with reference to the drawings showing the treatment of tobacco.

DETAILED DESCRIPTION OF THE PREFERRED EMBODIMENTS

Figure 1:
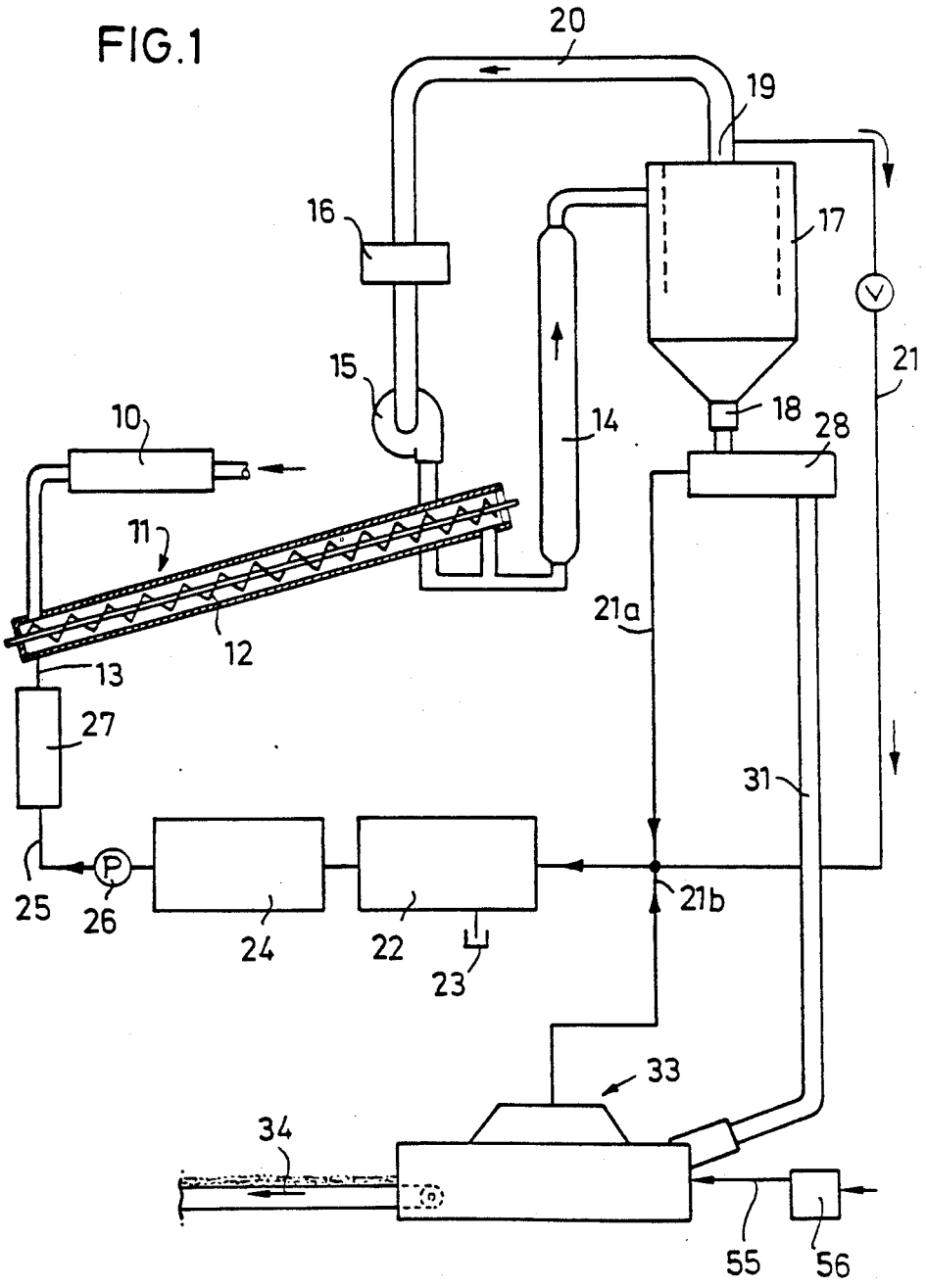
FIG. 1 is a schematic illustration of the entire process.

As shown in FIG. 1, tobacco is fed into impregnation device 11 via a humidifier 10. The impregnation device 11 consists of a worm conveyor 12 whose inlet end is supplied with the impregnating liquid in addition to the tobacco. This liquid is introduced in the form of a vapor via line 13. The inert organic liquid preferably consists of halogenated hydrocarbons, for example, trichlorofluoromethane (Frigen-11). Other inert organic liquids which are suitable for the expansion, are listed in DE-A 19 17 552 and DE-A-22 03 105.

From the outlet of worm conveyor 11 the tobacco proceeds to expander 14 which is supplied with hot steam from blower 15, the hot steam having been heated in heater 16. The temperature of the steam (or of another gas used as the heat carrier) is above the boiling temperature of the impregnation agent and results in vaporization of the agent thereby causing a volume enlargement of the tobacco material in expander 14.

A connecting line extends from the outlet of expander 14 to a cyclone 17. The tobacco descends in cyclone 17 to the lower outlet 18 while the gaseous components escape through the upper outlet 19. A return line 20 extends from outlet 19 to heater 16. Line 21 branches off return line 20 and extends to regenerator 22 in which the impregnation agent is separated from the vapor. The vapor components (water and air) are discharged into sump 23 while the impregnation agent is introduced into tank 24. Line 25, which contains a pump 26, leads from tank 24 to evaporator 27 whose outlet is connected to line 13. The evaporator 27 causes the impregnating liquid to be introduced into the impregnation device 11 in the vapor state.

From the outlet 18 of cyclone 17, the tobacco proceeds to a steam-operated separator 28 for the impregnation agent and from there moves to microwave oven 33 via a conveyor 31. Additional impregnating liquid still present in the tobacco is directed from separator 28 via line **21*a* into regenerator 22**.

The conveyor 31 leads to the microwave oven 33 from which the conditioned and loosely compacted, impregnant-free tobacco is removed via conveyor 34.

Figure 2:
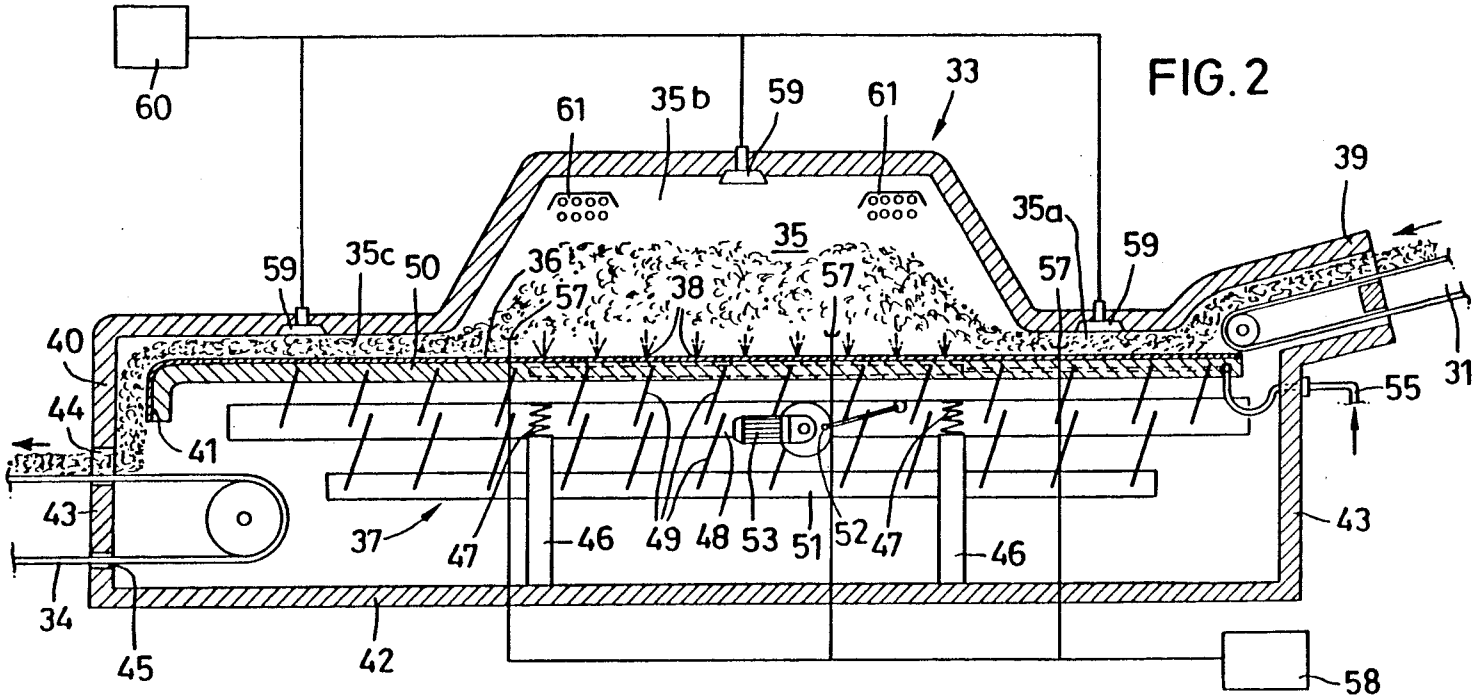
FIG. 2 is a schematic, detailed view of the microwave oven in which the second process step is carried out.

The microwave oven 33 is illustrated schematically in FIG. 2. It contains a microwave chamber 35 whose walls are coated with a high frequency shielding material. The microwave chamber 35 includes an inlet section **35*a* of small height, a central section 35*b* of somewhat greater height and an outlet section 35*c* of small height. The floor of microwave chamber 35 is formed substantially by the surface 36 of conveyor 37 which is also coated with a radiation shielding material. In the embodiment presented here conveyor 37 is a vibrating conveyor having a continuous conveying surface 36 which extends beneath all three sections 35*a*, 35*b* and 35*c*. Within central section 35*b* numerous nozzles 38 are associated with the conveying surface 36 for discharging air, gas or vapor to whirl up and to create a fluidized bed of the tobacco material 39 supported by the conveyor. No nozzles are provided in the inlet section 35*a* and in the outlet section 35*c*. The height of sections 35*a* and 35*c* roughly corresponds to the height of the tobacco layer on the conveyor 37 and the length of these sections is sufficient to prevent microwave energy from escaping from the microwave chamber 35. The conveyor 31 projects into a narrow channel 39 which leads into the inlet section 35*a*, the walls of the channel 39** also being shielded.

The discharge end of the conveying surface 36 is situated close to end wall 40 on the outlet side of the microwave chamber 40 and is provided with an extension 41 that projects downwardly. A narrow vertical chute is formed between end wall 40 and extension 41 through which the tobacco material falls onto the conveyor 34 located below the chute and extending out of the microwave oven 33. The width of the chute between walls 40 and 41 corresponds approximately to the height of inlet section **35*a* and outlet section 35*c*. A good shielding of the microwave chamber at the inlet and outlet ends is achieved by these narrow conveying paths and a labyrinth-like rerouting of the tobacco path. Additionally, the end walls 43, the side walls and bottom wall 42 of the microwave oven located below the conveying surface 36 are also coated with a shielding material as an additional safeguard against the escape of microwave energy. An opening 44 surrounding the upper path of conveyor 34 is provided through which the upper strand of conveyor 34 together with the tobacco material lying on it can pass. A narrow slot 45 in the end wall 40 of the microwave oven is provided to accommodate the lower strand of conveyor 34**.

The conveyor 37, which is completely contained within the microwave oven 33, comprises vertical support posts 46 which support conveyor frame 48 via springs 47. Numerous parallel leaf spring elements 49 project upwardly from the horizontal conveyor frame 48. The conveyor pan 50, whose upper side forms the conveying surface 36, is secured to the upper ends of the leaf spring elements 49. Beneath conveyor frame 48 and running parallel to conveyor pan 50 and conveyor frame 48 is counterweight 51 which is secured to additional leaf spring elements 49. The conveyor is activated by crankshaft 52, which is driven by the motor 53. The resulting vibrations of conveyor pan 50 cause the tobacco material supported thereon to move from the inlet section 35*a* through the central section 35*b* to the outlet section 35*c*.

The conveyor pan 50 is connected via a flexible hose to air conduit 55 coming from a conditioning device 56 (FIG. 1).

At various locations in microwave chamber 35 moisture and/or temperature sensors 57 are arranged to measure the moisture and temperature of the tobacco in a noncontacting manner with the signals from the sensors being processed by control device 58 which may, for example, be a microprocessor. The control device 58 controls the amount and/or temperature and/or moisture of the air introduced via conduit 55 and, if necessary, the speed of conveyor 37 as well.

Microwave emitters 61, which direct microwave energy toward the tobacco, are installed in the central section 35*b* of microwave chamber 35. The microwave energy of the microwave emitter 61 can also be regulated by the control device 58.

In order to siphon off the air and impregnation agent introduced into the microwave chamber, suction apertures 59 connected to a suction source 60 are located in all three sections 35*a*, 35*b* and 35*c*.

The tobacco material which is introduced into microwave chamber 35 is transported via conveyor 31 through the inlet section 35*a* and is placed on the conveyor 37. The layer of tobacco is so high that it substantially fills the inlet section 35*a* passageway without being compressed. In the central section 35*b*, the height of which is at least twice that of the inlet section 35*a*, the tobacco material is whirled up and fluidized by being blown at from below while it is simultaneously subjected to microwave treatment. Upon leaving the central section, the tobacco material comes to rest again on the conveying surface 36 as a loosely compacted layer in order to then be transported to conveyor 34 by which it is carried away.

What is claimed is:

1. A process for treating tobacco and similar organic materials comprising (a) impregnating the organic materials with an inert organic liquid and heating the impregnated materials above the boiling point of said inert organic liquid by contacting with a hot first gas under conditions which result in vaporization of the inert organic liquid and expansion of the organic materials, (b) recovering a portion of the vaporized inert organic liquid and collecting expanded organic materials containing residual amounts of said inert organic liquid, (c) subjecting the expanded organic materials to microwave radiation in a microwave chamber to vaporize the residual amounts of inert organic liquid contained in the expanded organic materials and (d) introducing a second gas into contact with the expanded organic materials while the expanded organic materials are being subjected to said microwave radiation whereby the inert organic liquid is expelled from the expanded organic materials and is carried away by said second gas.

2. The process of claim 1 wherein the expanded organic materials containing residual amounts of said inert organic liquid are conveyed into the microwave chamber supported by a conveying surface and said second gas is discharged into the organic materials from beneath said conveying surface.

3. The process of claim 2 wherein the discharge pressure of said second gas is sufficient to cause fluidization of the organic materials.

4. The process of claim 1, 2 or 3 wherein the second gas is treated in a conditioning device to adjust its moisture content and/or its temperature before it is introduced into contact with the expanded organic materials.

5. Apparatus for treating tobacco and similar organic materials which previously have been impregnated with an inert organic liquid and heated above the boiling point of the inert organic liquid with a hot first gas to produce expanded organic materials containing residual amounts of inert organic liquid, said apparatus comprising (a) a microwave chamber having an inlet section, an outlet section and a central section located between and connected to said inlet and outlet sections, (b) conveyor means arranged within said microwave chamber and having a conveying surface for supporting and transporting a layer of expanded organic materials containing residual amounts of inert organic liquid, (c) means for directing microwave energy into the central section of the microwave chamber to vaporize the residual amounts of inert organic liquid contained in the expanded organic materials and (d) nozzle means associated with said conveying surface in said central section of the microwave chamber for directing a second gas into contact with the organic materials as the organic materials are being subjected to microwave energy.

6. The apparatus of claim 5 wherein said conveyor means comprises a vibrating conveyor.

7. The apparatus of claim 5 wherein means are included for adjusting the moisture content and/or temperature of said second gas before it is directed into contact with the expanded organic materials.

8. The apparatus of claim 5, 6 or 7 wherein the conveying surface of said conveyor means substantially constitutes the floor of the microwave chamber and said conveying surface comprises a radiation shielding material.

9. The apparatus of claim 5 wherein the height of said microwave chamber above said conveying surface is significantly greater in the central section than in the inlet and outlet sections and said conveyor means extends substantially over the entire length of the inlet, central and outlet sections.

10. The apparatus of claim 9 wherein the conveying surface of said conveyor means substantially constitutes the floor of the microwave chamber and said conveying surface comprises a radiation shielding material.

* * * * *